US007432896B2

(12) United States Patent
Hoshino

(10) Patent No.: US 7,432,896 B2
(45) Date of Patent: Oct. 7, 2008

(54) METHOD OF DRIVING A LIQUID CRYSTAL DISPLAY PANEL

(75) Inventor: Masafumi Hoshino, Chiba (JP)

(73) Assignee: Seiko Instruments Inc. (JP)

( * ) Notice: Subject to any disclaimer, the term of this patent is extended or adjusted under 35 U.S.C. 154(b) by 643 days.

(21) Appl. No.: 10/980,526

(22) Filed: Nov. 3, 2004

(65) Prior Publication Data

US 2005/0128172 A1 Jun. 16, 2005

(30) Foreign Application Priority Data

Nov. 19, 2003 (JP) ..... 2003-389047

(51) Int. Cl.
*G09G 3/36* (2006.01)

(52) U.S. Cl. ..... 345/87; 345/94; 345/95; 345/98; 345/103

(58) Field of Classification Search ..... 345/87, 345/94–95, 98, 103
See application file for complete search history.

(56) References Cited

U.S. PATENT DOCUMENTS 6,900,788 B2 * 5/2005 Yamazaki ..... 345/103

* cited by examiner

*Primary Examiner*—Richard Hjerpe
*Assistant Examiner*—Leonid Shapiro
(74) *Attorney, Agent, or Firm*—Adams & Wilks

(57) ABSTRACT

A liquid crystal display panel comprises a liquid crystal layer disposed between a row electrode group and a column electrode group defining a plurality of pixels arranged in a matrix. Full screen display on the liquid crystal display panel is carried out using a multiple line addressing (MLA) drive method. Partial screen display on the liquid crystal display panel is carried out using a smart addressing (SA) drive method.

10 Claims, 1 Drawing Sheet

FIG. 1
(V)
| | | VCH | VSH | VM | VCL |
|---|---|---|---|---|---|
| MLA | 1/84 | 9.03 | 2.87 | 1.44 | −6.16 |
| | 1/24 | 5.76 | 3.01 | 1.51 | −2.75 |
| SA | 1/84 | 14.7 | 2.89 | 1.45 | −11.81 |
| | 1/24 | 9.03 | 3.06 | 1.53 | −5.97 |
FIG. 2
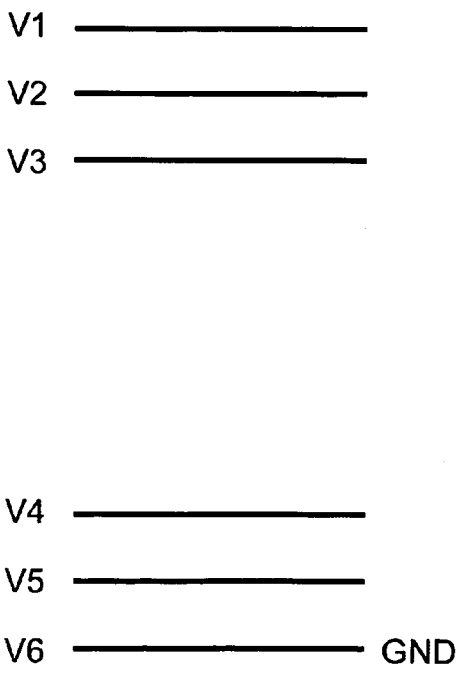
FIG. 3
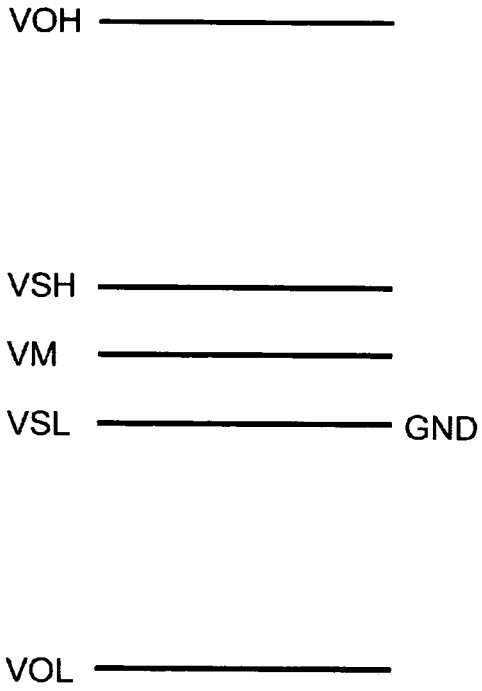

METHOD OF DRIVING A LIQUID CRYSTAL DISPLAY PANEL

BACKGROUND OF THE INVENTION

1. Field of the Invention

The present invention relates to a method of driving a simple matrix type liquid crystal display panel using STN liquid crystals or the like and, more particularly, to a method of driving a liquid crystal display panel so that time information is displayed on a portion of the screen when the display is not used for a mobile phone function or the like.

2. Description of the Related Art

A simple matrix type liquid crystal panel is constituted by maintaining a liquid crystal layer between a row electrode group and a column electrode group to define a plurality of pixels in matrix form. Further, as methods for driving the simple matrix type liquid crystal display panel, there are the voltage averaging drive method, the SA drive method, and the MLA drive method.

The voltage averaging drive method is a method of driving a simple matrix type liquid crystal display panel for successively selecting respective row electrodes piece by piece and providing all the column electrodes with data signals in correspondence with ON and OFF in accordance with selected timings. Therefore, a voltage applied to respective electrodes becomes high only once in one frame cycle T for selecting all the row electrodes and becomes constant bias voltage during a remaining nonselection time period. According to the voltage averaging drive, when a response speed of the liquid crystal material used is slow, there is provided a change in brightness in accordance with the effective value of the waveform of the applied voltage in the one frame cycle to thereby maintain the most suitable contrast for the conditions. However, when the division number is increased and frame frequency is reduced, the difference between frame cycle time and response time of liquid crystal is reduced, the liquid crystal responds separately to each applied pulse, there appears flicker of brightness referred to as a frame response phenomenon, and the contrast is reduced.

The SA drive method is a method of driving a simple matrix type liquid crystal display panel and is referred to as a smart addressing method. The voltage averaging drive and the SA drive methods both select each row of electrodes one row at a time in order, and provide a data signal corresponding to turn on or turn off to each column of electrodes at a selected timing. However, common nonselection levels for adjacent frames differ in the voltage averaging drive, but are the same in the SA drive. Therefore, in the SA drive, too, when the division number is increased and frame frequency is reduced, there appears flicker of brightness referred to as a frame response phenomenon and the contrast is reduced similar to the voltage averaging drive. Further, a common driver waveform voltage is applied to a positive polarity side and a negative polarity side centered about a nonselect level. Consequently, an IC withstand voltage of twice that used in the voltage averaging drive becomes necessary.

The MLA drive method is also referred to as the multiple line addressing or multiple line selecting method for simultaneously selecting a plurality of row electrodes so that apparent high frame frequency formation is achieved and the frame response phenomenon which is problematic in the voltage averaging drive and the SA drive methods is restrained. The MLA driving method simultaneously selects a plurality of row electrodes and display respective pixels independently from each other. In this scheme there is carried out set successive scanning applying a plurality of row signals represented by a set of orthogonal functions to a row electrode group according to a set order for each respective selection time, there is successively carried out a crossproducts operation between the set of orthogonal functions and a set of selected pixel data, and column signals having voltage levels in accordance with the result of the operation are applied to a column electrode group during the selection time in synchronism with the successive scanning of the set (See JP 06-236167 A).

As described above, the SA drive has disadvantages in that the frame response phenomenon appears, and driver voltages become higher, when the number of divisions becomes larger. However, the frame response phenomenon does not appear when the number of divisions is small, and the driver voltage can also be reduced. The electric power consumption can also be made smaller compared to the MLA drive because there is no product and summing operations.

Further, the MLA drive has a disadvantage in that product and summing operations are performed. The number of times where data is read out from memory is thus increased, and the electric power consumption in a logic circuit portion becomes higher than that of the SA drive. However, the MLA drive has an advantage in that there is no frame response phenomenon, even if the number of divisions is large.

Voltage levels necessary for signal electrodes and scanning electrodes for each method are examined next. FIG. 2 shows a voltage configuration used in the voltage averaging drive, while FIG. 3 shows a voltage configuration used in the SA and MLA drives.

Referring to FIG. 2, in the voltage averaging drive, the voltages necessary for the scanning side are voltages V1, V2, V5, and V6, while the voltages necessary for the signal side are voltages V1, V3, V4, and V6. Referring to FIG. 3, in the SA drive, the scanning side needs voltages VCH, VM, and VCL, while the signal side needs voltages VSH and VSL. Further, taking the number of simultaneously selected scanning lines as three in the MLA drive, and by adding one dummy scanning electrode, there are two voltage levels used on the signal side, the voltages VSH and VSL, the same as those used in the SA drive.

When display on a full screen is mixed with display on only a portion of the screen in a simple matrix type liquid crystal display panel and the same driving method is used, a region where operation voltages differ is used due to differences in duty, and the design of an output portion of a driver IC becomes complex. Further, although the operating voltage range does not change when display is performed to only a portion of the screen without changing the duty, the electric power consumption does not decrease.

SUMMARY OF THE INVENTION

In view of the above circumstances, problems to be solved by the present invention are to simplify designing of a driver IC and to reduce electric power consumption during partial screen display.

In order to achieve the objects described above, an object of the present invention is to provide a method of driving a simple matrix type liquid crystal display panel, which is configured to use MLA drive when performing full screen display onto a liquid crystal display panel, and SA drive when displaying onto only a portion of the screen of the liquid crystal display panel.

Comparing the MLA drive method and the SA drive method, the SA drive method is the same as the MLA drive with three selections plus a dummy method. Accordingly, both driving methods can be used to drive a liquid crystal panel, without changing the configuration of a driver IC.

Further, at the same duty, the voltage on a scanning side becomes lower with the MLA drive in a voltage range used for driving electrodes, while the scanning side voltage becomes higher with the SA drive. Voltages on a signal side are substantially the same with both methods. Driving is therefore performed by the MLA drive when performing full screen display at high duty, while driving is performed by the SA drive when displaying to only a portion of the screen at a low duty. Driving of scanning electrodes can thus be performed within a fixed voltage range.

BRIEF DESCRIPTION OF THE DRAWINGS

In the accompanying drawings:

FIG. 1 shows voltages used by a driving method of the present invention;

FIG. 2 is a diagram that shows a configuration of voltages used in a voltage averaging drive; and FIG. 3 is a diagram that shows a configuration of voltages used in an SA drive and an MLA drive.

DETAILED DESCRIPTION OF THE PREFERRED EMBODIMENTS

An MLA drive is used to perform full screen display and an SA drive is used to perform partial screen display in a method of driving a liquid crystal display panel of the present invention. Voltages used are the same as those of the configuration shown in FIG. 3.

The MLA drive used for performing full screen display is an MLA drive with three selection lines plus one dummy. The three selection lines plus one dummy MLA drive uses three lines of row electrodes in an MLA drive with four selections and one line for virtual electrode. One frame is divided into four sub-frames. Three lines of common electrodes are selected at a time from an upper portion of a screen in each of the sub-frames, and three row portions of image data corresponding to the three lines selected are read out from RAM. Line functions and product and summing computations are made, thus determining electric potentials for segmented electrodes. The electric potentials of the segmented electrodes are thus computed and determined at 4/3 times the number of display rows during one frame.

In the SA drive used for partial screen display, one line of row electrodes at a time is selected from an upper portion of a display portion. Image data corresponding to that row is read out from the RAM, and the data determines the electric potential of the segmented electrodes as is.

As described above, the number of read-outs from RAM with the MLA drive is equal to:

$$\text{number of rows displayed} \times 3 \times (4/3),$$

which is four times as many read-outs as with the SA drive. In addition, line functions and product and summing operations are necessary with the MLA drive, and the electric power consumption thus increases.

For high duty drive it is necessary to perform drive by using the MLA drive in order to suppress the frame response phenomenon described above. However, the frame response phenomenon does not appear at low duty drive, and it is thus sufficient to perform drive by using the SA drive.

Electric power consumption decreases with the present invention because the SA drive is used for partial screen display, which is low duty driving. Only electrodes corresponding to the partial screen display are taken as scanning electrodes, and it is also possible to further reduce the electric power consumed by the scanning electrodes.

FIG. 1 shows an example of voltages used for a case where an STN liquid crystal panel having 84 lines of scanning electrodes is driven by using the MLA drive when performing full screen display, and by using the SA drive when displaying only 24 lines.

There is a 1/84 duty when performing full screen display by using the MLA drive.

VCH=9.03V
VSH=2.87V
VM=1.44V
VCL=−6.16V

There is a 1/24 duty when performing display to only 24 lines within the full screen with the SA drive.

VCH=9.03V
VSH=3.06V
VM=1.53V
VCL=−5.97V

Driver voltages naturally change when the Vth of the liquid crystals changes. However, the proportional relationship of the voltages used in the MLA drive and the SA drive does not change.

The difference between the voltages used for VCH and VCL is equal to or greater than 1.5 times when performing drive at 1/84 duty and 1/24 duty using the same method of driving. When the same output transistor is used, it is necessary to fix its output characteristics within a wide range. However, the range of voltages used for the driver electrodes of the driver IC can be narrowed according to the driving method of the present invention. Design of the transistor, the electric power source generator circuit, and the like can therefore be simplified, and the chip size can be made smaller.

By using SA drive to perform partial screen display in the method of driving a liquid crystal display panel of the present invention, the number of times read-out from RAM is performed decreases compared to MLA drive, and in addition, electric power consumption decreases because a computation circuit is stopped. Further, by using MLA drive to perform full screen display, and SA drive to perform partial screen display, the voltage range used for driver electrodes of a driver IC may be kept narrow because the voltages used by the two driving methods are close. Consequently, the design of transistors, electric power source generator circuits and the like can be simplified, and the chip size becomes smaller. It thus becomes possible to provide a low cost driver IC.

What is claimed is:

1. A method of driving a liquid crystal display panel that includes that includes a liquid crystal layer disposed between a row electrode group and a column electrode group defining a plurality of pixels arranged in a matrix, the method comprising the steps of:

performing full screen display to the liquid crystal display panel using a multiple line addressing (MLA) method; and performing partial screen display to the liquid crystal display panel using a smart addressing (SA) method;

wherein the step of performing full screen display includes the steps of simultaneously selecting three of the row electrodes. adding one virtual line. and setting output voltages of the column electrodes to only two levels.

2. A method of driving a liquid crystal display panel according to claim 1; wherein the step of performing partial screen display includes the step of setting the number of row electrodes to a portion of the total number of row electrodes.

3. A method of driving a liquid crystal display panel according to claim 1; wherein the MLA method is performed in accordance with an MLA driver circuit; and wherein the SA method is performed using a portion of the MLA driver circuit.

4. A method of driving a liquid crystal display panel according to claim 1; wherein the step of performing partial screen display comprises the step of performing partial screen display of time information.

5. A method of driving a liquid crystal display panel according to claim 1; wherein the liquid crystal display panel comprises a liquid crystal display panel for a telephone; and wherein the step of performing partial screen display comprises the step of performing partial screen display of time information.

6. A method of driving a liquid crystal display panel that includes a liquid crystal layer disposed between a row electrode group and a column electrode group defining a plurality of pixels arranged in a matrix, the method comprising the steps of:

applying driving signals to the liquid crystal display panel by applying scan signals to the row electrode group and data signals to the column electrode group according to a multiple line addressing (MLA) method to effect full screen display on the liquid crystal display panel; and applying driving signals to the liquid crystal display panel by applying scan signals to the row electrode group and data signals to the column electrode group according to a smart addressing (SA) method to effect partial screen display on the liquid crystal display panel;

wherein the step of applying driving signals according to the MLA method includes the steps of simultaneously selecting three of the row electrodes, adding one virtual line, and setting output voltages of the column electrodes to only two levels.

7. A method of driving a liquid crystal display panel according to claim 6; wherein the step of applying driving signals according to the SA method includes the step of setting the number of row electrodes to a portion of the total number of row electrodes.

8. A method of driving a liquid crystal display panel according to claim 6; wherein the MLA method is performed in accordance with an MLA driver circuit; and wherein the step of applying driving signals according to the SA method includes the step of performing the SA method using a portion of the MLA driver circuit.

9. A method of driving a liquid crystal display panel according to claim 6; wherein the step of applying driving signals according to the SA method includes performing partial screen display of time information.

10. A method of driving a liquid crystal display panel according to claim 6; wherein the liquid crystal display panel comprises a liquid crystal display panel for a telephone; and wherein the step of applying driving signals according to the SA method includes performing partial screen display of time information.

* * * * *